US009309490B2

(12) United States Patent
Silvernail et al.

(10) Patent No.: US 9,309,490 B2
(45) **Date of Patent: *Apr. 12, 2016**

(54) CLEANING COMPOSITION CONTAINING A POLYSACCHARIDE GRAFT POLYMER COMPOSITON AND METHODS OF IMPROVING DRAINAGE

(71) Applicants: Ecolab USA Inc., St. Paul, MN (US); Akzo Nobel Surface Chemistry LLC, Chicago, IL (US)

(72) Inventors: Carter M. Silvernail, Burnsville, MN (US); Erik C. Olson, Savage, MN (US); Klin Rodrigues, Signal Mountain, TN (US)

(73) Assignees: Ecolab USA Inc., St. Paul, MN (US); Akzo Nobel Surface Chemistry LLC, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/490,830

(22) Filed: Sep. 19, 2014

(65) Prior Publication Data

US 2015/0005218 A1 Jan. 1, 2015

Related U.S. Application Data

(63) Continuation of application No. 13/561,485, filed on Jul. 30, 2012, now Pat. No. 8,853,144, which is a continuation-in-part of application No. 13/204,368, filed on Aug. 5, 2011, now abandoned.

(51) Int. Cl.

| | |
|---|---|
| ***C11D 3/22*** | (2006.01) |
| ***B08B 3/04*** | (2006.01) |
| ***C11D 7/26*** | (2006.01) |
| ***C11D 3/04*** | (2006.01) |
| ***C11D 3/37*** | (2006.01) |
| ***C11D 7/06*** | (2006.01) |

(52) U.S. Cl.

CPC ..... *C11D 7/268* (2013.01); *C11D 3/044* (2013.01); *C11D 3/3788* (2013.01); *C11D 7/06* (2013.01)

(58) Field of Classification Search

CPC ..... C11D 3/044; C11D 3/22; C11D 3/3788; C11D 3/3707; B08B 3/04

See application file for complete search history.

(56) References Cited

U.S. PATENT DOCUMENTS

| | | | |
|---|---|---|---|
| 2,536,658 | A | 2/1951 | Rheineck |
| 2,798,053 | A | 7/1957 | Brown |
| 2,954,347 | A | 9/1960 | St. John et al. |
| 3,048,548 | A | 8/1962 | Martin et al. |
| 3,308,067 | A | 3/1967 | Diehl |
| 3,314,891 | A | 4/1967 | Schmolka et al. |
| 3,334,147 | A | 8/1967 | Brunelle |
| 3,442,242 | A | 5/1969 | Laskey et al. |
| 3,455,839 | A | 7/1969 | Rauner |
| 3,518,176 | A | 6/1970 | Reyes et al. |
| 3,629,121 | A | 12/1971 | Eldib et al. |
| 3,639,312 | A | 2/1972 | Turner et al. |
| 3,673,148 | A | 6/1972 | Vasta |
| 3,687,878 | A | 8/1972 | Imoto et al. |
| 3,723,322 | A | 3/1973 | Diehl |
| 3,803,285 | A | 4/1974 | Jensen |
| 3,929,107 | A | 12/1975 | Renger |
| 3,929,678 | A | 12/1975 | Laughlin et al. |
| 3,933,672 | A | 1/1976 | Bartolotta et al. |
| 4,048,122 | A | 9/1977 | Sibley et al. |
| 4,133,779 | A | 1/1979 | Hellyer et al. |
| 4,141,841 | A | 2/1979 | McDanald |
| 4,228,042 | A | 10/1980 | Letton |
| 4,239,660 | A | 12/1980 | Kingry |
| 4,260,529 | A | 4/1981 | Letton |
| 4,265,779 | A | 5/1981 | Gandolfo et al. |
| 4,322,472 | A | 3/1982 | Kaspar et al. |
| 4,374,035 | A | 2/1983 | Bossu |
| 4,379,080 | A | 4/1983 | Murphy |
| 4,388,205 | A | 6/1983 | Stettler et al. |
| 4,412,934 | A | 11/1983 | Chung et al. |
| 4,483,779 | A | 11/1984 | Llenado et al. |
| 4,483,780 | A | 11/1984 | Llenado |
| 4,521,578 | A | 6/1985 | Chen et al. |
| 4,536,314 | A | 8/1985 | Hardy et al. |
| 4,539,130 | A | 9/1985 | Thompson et al. |
| 4,557,763 | A | 12/1985 | George et al. |

(Continued)

FOREIGN PATENT DOCUMENTS

| | | |
|---|---|---|
| CA | 2074747 | 2/1993 |
| DE | 4038908 | 6/1992 |

(Continued)

OTHER PUBLICATIONS

Dubois, Michel et al., "Colorimetric Method for Determination of Sugars and Related Substances", Analytical Chemistry, Vo. 28, No. 3, pp. 350-356. Mar. 31, 1956.

European Search Report issued in EP Application No. 06015025, 9 pages, completed Nov. 13, 2006.

European Search Report issued in EP Application No. 07014412, 2 pages, completed Jan. 23, 2008.

European Search Report issued in EP Application No. 07014412, 3 pages, completed Oct. 18, 2007.

European Search Report issued in EP Application No. 07014413, 12 pages, completed Nov. 6, 2007.

European Search Report issued in EP Application No. 09175465, 6 pages, completed Jan. 14, 2010.

Herman, Mark F., "Encyclopedia of Polymer Science and Technology", vol. 11, John Wiley & Sons, Inc., p. 380. Dec. 31, 2004.

International Search Report and Written Opinion issued in PCT/US2012/049608, 13 pages, mailed Mar. 22, 2013.

(Continued)

*Primary Examiner* — Brian P Mruk

(74) *Attorney, Agent, or Firm* — McKee, Voorhees & Sease, PLC

(57) ABSTRACT

A composition includes a polysaccharide graft polymer composition. In one embodiment, the polysaccharide graft polymer composition includes a polysaccharide residue present in an amount from about 5% to about 90% by weight of the polysaccharide graft polymer composition and a residue of at least one ethylenically unsaturated monomer present in an amount from about 10% to about 75% by weight of the polysaccharide graft polymer composition.

20 Claims, No Drawings

(56) References Cited

U.S. PATENT DOCUMENTS

| | | | | |
|---|---|---|---|---|
| 4,565,647 | A | 1/1986 | Llenado | |
| 4,597,898 | A | 7/1986 | Vander Meer | |
| 4,605,721 | A | 8/1986 | Jenkins et al. | |
| 4,606,838 | A | 8/1986 | Burns | |
| 4,618,914 | A | 10/1986 | Sato et al. | |
| 4,634,551 | A | 1/1987 | Burns et al. | |
| 4,652,392 | A | 3/1987 | Baginski et al. | |
| 4,671,891 | A | 6/1987 | Hartman | |
| 4,681,592 | A | 7/1987 | Hardy et al. | |
| 4,681,695 | A | 7/1987 | Divo | |
| 4,681,704 | A | 7/1987 | Bernardino et al. | |
| 4,686,063 | A | 8/1987 | Burns | |
| 4,702,857 | A | 10/1987 | Gosselink | |
| 4,782,901 | A | 11/1988 | Phelps et al. | |
| 4,830,773 | A | 5/1989 | Olson | |
| 4,963,629 | A | 10/1990 | Driemel et al. | |
| 4,968,451 | A | 11/1990 | Scheibel et al. | |
| 5,032,659 | A | 7/1991 | Heidel | |
| 5,071,895 | A | 12/1991 | Hughes et al. | |
| 5,076,868 | A | 12/1991 | Doll et al. | |
| 5,121,795 | A | 6/1992 | Ewert et al. | |
| 5,125,455 | A | 6/1992 | Harris et al. | |
| 5,127,795 | A | 7/1992 | Plemmons et al. | |
| 5,248,449 | A | 9/1993 | Mitchell et al. | |
| 5,264,470 | A | 11/1993 | Eoff | |
| 5,304,620 | A | 4/1994 | Holtmyer et al. | |
| 5,326,864 | A | 7/1994 | Besemer et al. | |
| 5,332,528 | A | 7/1994 | Pan et al. | |
| 5,378,830 | A | 1/1995 | Yeh | |
| 5,415,807 | A | 5/1995 | Gosselink et al. | |
| 5,435,935 | A | 7/1995 | Kupneski | |
| 5,478,503 | A | 12/1995 | Swift | |
| 5,500,154 | A | 3/1996 | Bacon et al. | |
| 5,543,459 | A | 8/1996 | Hartmann et al. | |
| 5,547,612 | A | 8/1996 | Austin et al. | |
| 5,565,145 | A | 10/1996 | Watson et al. | |
| 5,580,154 | A | 12/1996 | Coulter et al. | |
| 5,583,193 | A | 12/1996 | Aravindakshan et al. | |
| 5,654,198 | A | 8/1997 | Carrier et al. | |
| 5,670,475 | A | 9/1997 | Trinh et al. | |
| 5,753,770 | A | 5/1998 | Breitenbach et al. | |
| 5,852,069 | A | 12/1998 | Meister et al. | |
| 5,854,321 | A | 12/1998 | Krause et al. | |
| 5,942,485 | A | 8/1999 | Kemen | |
| 5,945,127 | A | 8/1999 | Breitenbach et al. | |
| 5,952,278 | A | 9/1999 | Mao et al. | |
| 5,990,065 | A | 11/1999 | Vinson et al. | |
| 6,004,922 | A | 12/1999 | Watson et al. | |
| 6,008,181 | A | 12/1999 | Cripe et al. | |
| 6,020,303 | A | 2/2000 | Cripe et al. | |
| 6,022,844 | A | 2/2000 | Baillely et al. | |
| 6,060,299 | A | 5/2000 | Sreekrishna et al. | |
| 6,060,443 | A | 5/2000 | Cripe et al. | |
| 6,060,582 | A | 5/2000 | Hubbell et al. | |
| 6,069,122 | A | 5/2000 | Vinson et al. | |
| 6,093,856 | A | 7/2000 | Cripe et al. | |
| 6,103,839 | A | 8/2000 | Patel et al. | |
| 6,130,194 | A | 10/2000 | Pancheri et al. | |
| 6,136,769 | A | 10/2000 | Asano et al. | |
| 6,143,707 | A | 11/2000 | Trinh et al. | |
| 6,150,322 | A | 11/2000 | Singleton et al. | |
| 6,153,577 | A | 11/2000 | Cripe et al. | |
| 6,221,825 | B1 | 4/2001 | Williams, Jr. et al. | |
| 6,227,446 | B1 | 5/2001 | Haney et al. | |
| 6,231,650 | B1 | 5/2001 | Mallow et al. | |
| 6,258,765 | B1 | 7/2001 | Wei et al. | |
| 6,365,561 | B1 | 4/2002 | Vinson et al. | |
| 6,372,708 | B1 | 4/2002 | Kasturi et al. | |
| 6,384,132 | B1 | 5/2002 | Horley et al. | |
| 6,482,994 | B2 | 11/2002 | Scheper et al. | |
| 6,528,477 | B2 | 3/2003 | Kasturi et al. | |
| 6,573,234 | B1 | 6/2003 | Sivik et al. | |
| 6,589,926 | B1 | 7/2003 | Vinson et al. | |
| 6,627,590 | B1 | 9/2003 | Sherry et al. | |
| 6,645,925 | B2 | 11/2003 | Sivik et al. | |
| 6,653,266 | B2 | 11/2003 | Wei et al. | |
| 6,656,900 | B2 | 12/2003 | Sivik et al. | |
| 6,764,992 | B2 | 7/2004 | Kumar et al. | |
| 6,800,712 | B2 | 10/2004 | Doane et al. | |
| 6,867,262 | B1 | 3/2005 | Angel et al. | |
| 6,908,955 | B2 | 6/2005 | Prsch et al. | |
| 7,153,821 | B2 | 12/2006 | Blokzijl et al. | |
| 8,227,381 | B2 | 7/2012 | Rodrigues et al. | |
| 8,636,918 | B2 * | 1/2014 | Silvernail et al. | 252/175 |
| 8,679,366 | B2 * | 3/2014 | Silvernail et al. | 252/175 |
| 8,841,246 | B2 * | 9/2014 | Silvernail et al. | 510/470 |
| 8,853,144 | B2 * | 10/2014 | Silvernail et al. | 510/470 |
| 2002/0173592 | A1 | 11/2002 | Saeki et al. | |
| 2003/0008793 | A1 | 1/2003 | Takiguchi et al. | |
| 2004/0033929 | A1 | 2/2004 | Bertleff et al. | |
| 2004/0039137 | A1 | 2/2004 | Heinemann et al. | |
| 2004/0266655 | A1 | 12/2004 | Baum et al. | |
| 2005/0108832 | A1 | 5/2005 | Torri et al. | |
| 2005/0171287 | A1 | 8/2005 | Baum et al. | |
| 2005/0176878 | A1 | 8/2005 | Ettl et al. | |
| 2006/0024353 | A1 | 2/2006 | Trouve et al. | |
| 2006/0029561 | A1 | 2/2006 | Gunn et al. | |
| 2006/0106186 | A1 | 5/2006 | Dupont et al. | |
| 2006/0111511 | A1 | 5/2006 | Narayan et al. | |
| 2006/0182917 | A1 | 8/2006 | Wood et al. | |
| 2006/0183203 | A1 | 8/2006 | DeAngelis | |
| 2006/0183856 | A1 | 8/2006 | Wood et al. | |
| 2006/0183857 | A1 | 8/2006 | Wood et al. | |
| 2006/0252901 | A1 | 11/2006 | Narayan et al. | |
| 2007/0138105 | A1 | 6/2007 | Takeda et al. | |
| 2007/0260046 | A1 | 11/2007 | Tomita et al. | |
| 2008/0020948 | A1 | 1/2008 | Rodrigues et al. | |
| 2008/0020961 | A1 * | 1/2008 | Rodrigues et al. | 510/475 |
| 2008/0230193 | A1 | 9/2008 | Mori et al. | |
| 2008/0274940 | A1 | 11/2008 | Tjelta et al. | |
| 2008/0274942 | A1 | 11/2008 | Tjelta et al. | |
| 2008/0277620 | A1 | 11/2008 | Kesavan et al. | |
| 2009/0011973 | A1 | 1/2009 | Besse et al. | |
| 2009/0176687 | A1 | 7/2009 | Tjelta et al. | |
| 2010/0236736 | A1 | 9/2010 | Brockmeyer et al. | |
| 2010/0280146 | A1 | 11/2010 | Vanderlaan et al. | |
| 2011/0021734 | A1 | 1/2011 | Samaranayake et al. | |
| 2012/0128608 | A1 | 5/2012 | Rodrigues et al. | |
| 2012/0134942 | A1 | 5/2012 | Thomaides et al. | |

FOREIGN PATENT DOCUMENTS

| | | |
|---|---|---|
| EP | 0130756 | 1/1985 |
| EP | 0130759 | 1/1985 |
| EP | 04838215 | 7/1991 |
| EP | 0441197 | 8/1991 |
| EP | 0577519 | 1/1994 |
| EP | 0605084 | 7/1994 |
| EP | 0797656 | 5/2000 |
| EP | 1881017 | 1/2008 |
| EP | 1950232 | 7/2008 |
| EP | 2072531 | 6/2009 |
| FR | 2908135 | 5/2008 |
| FR | 2927083 | 8/2009 |
| JP | 57082145 | 5/1982 |
| JP | 11343449 | 12/1999 |
| JP | 2005120045 | 5/2005 |
| JP | 2010047713 | 3/2010 |
| JP | 2011195809 | 10/2011 |
| WO | 9006125 | 6/1990 |
| WO | 9106637 | 5/1991 |
| WO | 9206162 | 4/1992 |
| WO | 9210433 | 6/1992 |
| WO | 9319038 | 9/1993 |
| WO | 9319146 | 9/1993 |
| WO | 9409099 | 4/1994 |
| WO | 9510591 | 4/1995 |
| WO | 9526393 | 10/1995 |
| WO | 9835002 | 8/1998 |
| WO | 9835003 | 8/1998 |
| WO | 9835004 | 8/1998 |
| WO | 9835005 | 8/1998 |
| WO | 9835006 | 8/1998 |
| WO | 9902663 | 1/1999 |

(56) References Cited

FOREIGN PATENT DOCUMENTS

| | | |
|---|---|---|
| WO | 9905082 | 2/1999 |
| WO | 9905084 | 2/1999 |
| WO | 9905241 | 2/1999 |
| WO | 9905242 | 2/1999 |
| WO | 9905243 | 2/1999 |
| WO | 9907656 | 2/1999 |
| WO | 9920726 | 4/1999 |
| WO | 9927083 | 6/1999 |
| WO | 0020470 | 4/2000 |
| WO | 0023548 | 4/2000 |
| WO | 0047708 | 8/2000 |
| WO | 0132816 | 5/2001 |
| WO | 0142408 | 6/2001 |
| WO | 03042262 | 5/2003 |
| WO | 2004048418 | 6/2004 |
| WO | 2005051343 | 6/2005 |
| WO | 2006002565 | 1/2006 |
| WO | 2006007945 | 1/2006 |
| WO | 2006119162 | 11/2006 |
| WO | 2007140267 | 12/2007 |
| WO | 2008144744 | 11/2008 |
| WO | 2008147940 | 12/2008 |
| WO | 2009006603 | 1/2009 |
| WO | 2009087525 | 7/2009 |
| WO | 2009156233 | 12/2009 |
| WO | 2010057977 | 5/2010 |
| WO | 2010065482 | 6/2010 |
| WO | 2010065483 | 6/2010 |
| WO | 2010079466 | 7/2010 |
| WO | 2010079467 | 7/2010 |
| WO | 2011014783 | 2/2011 |
| WO | 2011025624 | 3/2011 |

OTHER PUBLICATIONS

Kahya, Suat et al., "A Novel Copolymer: Starch-g-Polyvinylpyrrolidone", Starch, vol. 61, pp. 267-274. Dec. 31, 2009.

Kirk-Othmer Encyclopedia of Chemical Technology, 3rd Edition, vol. 7, John Wiley & Sons, pp. 430-447. Dec. 31, 1979.

Kroschwitz, Jacqueline I., "Concise Encyclopedia of Polymer Science and Engineering", John Wiley & Sons, Inc., p. 436. Dec. 31, 1990.

Kwei, Kwei-Ping S. et al., "Chain Transfer Constant of vinylpyrrolidone with Dextran", Institute of Polymer Research, vol. 66, pp. 828-829. May 31, 1962.

Menger, F.M., et al., "Gemini Surfactants: A New Class of Self-Assembling Molecules", J. Am. Chem. Soc. vol. 115, pp. 10083-10090. Dec. 31, 1993.

Odian, George, "Principles of Polymerization", 2nd Edition, John Wiley & Sons, Inc., p. 226. Dec. 31, 1981.

Odian, George, Principles of Polymerization, McGraw-Hill Inc., p. 424. Dec. 31, 1970.

Pal, S. et al., "Cathionic Startch: an effective flocculating agent", Carbohydrate Polymers, vol. 59, pp. 417-423. Dec. 31, 2005.

Rosen, Milton J., "Geminis: A New Generation of Surfactants", Chemtech, pp. 30-33. Mar. 31, 1993.

Shen, K.P. et al., "Graft Copolymers of Vinyl Pyrrolidone on Dextran", Journal of Polymer Science, vol. 53, pp. 81-85. Dec. 31, 1961.

Wurzburg, O.B., "Modified Starches: Properties and Uses", Chapter 10 Grafted Starches, CRC Press, Inc., pp. 149-172. Dec. 31, 1986.

International Search Report and Written Opinion issued in PCT/US2010/043919, 13 pages mailed Sep. 30, 2010.

International Search Report and Written Opinion issued in PCT/US2010/043930, 16 pages, mailed Dec. 14, 2010.

* cited by examiner

CLEANING COMPOSITION CONTAINING A POLYSACCHARIDE GRAFT POLYMER COMPOSITON AND METHODS OF IMPROVING DRAINAGE

CROSS REFERENCE TO RELATED APPLICATIONS

This is a Continuation Application of U.S. Ser. No. 13/561,485 filed Jul. 30, 2012, now U.S. Pat. No. 8,853,144 issued Oct. 7, 2014, which is a Continuation-in-Part Application of U.S. Ser. No. 13/204,368 filed on Aug. 5, 2011, (now abandoned) all of which applications are incorporated by reference in their entirety herein.

TECHNICAL FIELD

The present invention is related to the field of improving rinse water drainage. In particular, the present invention is related to a cleaning composition including a polysaccharide graft polymer composition for improving rinse water drainage, particularly in a high alkaline environment.

BACKGROUND

Conventional detergents used in food and beverage (e.g., the dairy, cheese, sugar, meat, food, and brewery and other beverage industries), warewashing and laundry industries include alkaline detergents. Alkaline detergents, particularly those intended for institutional and commercial use, generally contain phosphates, nitrilotriacetic acid (NTA) and ethylenediaminetetraacetic acid (EDTA). Phosphates, NTA and EDTA are components commonly used in detergents to remove soils and to sequester metal ions such as calcium, magnesium and iron.

In particular, NTA, EDTA or polyphosphates such as sodium tripolyphosphate and their salts are used in detergents because of their ability to solubilize preexisting inorganic salts and/or soils. When calcium, magnesium and iron salts precipitate, the crystals may attach to the surface being cleaned and cause undesirable effects. For example, calcium carbonate precipitation on the surface of ware can negatively impact the aesthetic appearance of the ware, giving an unclean look. In the laundering area, if calcium carbonate precipitates and attaches onto the surface of fabric, the crystals may leave the fabric feeling hard and rough to the touch. In the food and beverage industry, the calcium carbonate residue can affect the acidity levels of foods. The ability of NTA, EDTA and polyphosphates to remove metal ions facilitates the detergency of the solution by preventing hardness precipitation, assisting in soil removal and/or preventing soil redeposition into the wash solution or wash water.

While effective, phosphates and NTA are subject to government regulations due to environmental and health concerns. Although EDTA is not currently regulated, it is believed that government regulations may be implemented due to environmental persistence. Therefore, there is a need in the art for an alternative, and preferably environmentally friendly, cleaning composition that can replace the properties of phosphorous-containing compounds such as phosphates, phosphonates, phosphites, and acrylic phosphinate polymers, as well as non-biodegradable aminocarboxylates such as NTA and EDTA.

SUMMARY

The present invention includes a cleaning composition for controlling hard water scale accumulation. The cleaning composition includes a polysaccharide graft polymer composition. In an embodiment, the polysaccharide graft polymer composition includes a polysaccharide residue present in an amount from about 5% to about 90% by weight of the polymer and a residue of at least one ethylenically unsaturated monomer present in an amount from about 10% to about 75% by weight of the polysaccharide graft polymer.

In another embodiment, the cleaning composition is used by mixing water with the composition to form a use solution. The water and composition is mixed so that the use solution has a polysaccharide graft polymer composition concentration from about 1 part-per-million (ppm) to about 500 ppm.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DETAILED DESCRIPTION

The present cleaning compositions include a polysaccharide graft polymer composition. Such cleaning compositions may be useful in improving drainage, particularly in water treatment applications and in high alkaline environments. Further, such cleaning compositions can be biodegradable and substantially free of phosphorous containing components to comply with various regulatory requirements.

The present compositions can be used in any environment in which it is desirable to improve drainage and to remove or prevent redeposition of soil, such as protein, on surfaces such as but not limited to plastic, glass, ceramic and metal. Example applications include warewashing, laundering, institutional, health care, food and beverage, and water treatment applications. More particularly, example applications include, but are not limited to: machine and manual warewashing, presoaks, laundry and textile cleaning and destaining, carpet cleaning and destaining, surface cleaning and destaining, kitchen and bath cleaning and destaining, floor cleaning and destaining, cleaning in place operations, general purpose cleaning and destaining, industrial or household cleaners, and industrial or municipal water systems. The present compositions may also be used as textile scours, mineral deposition, or in oilfield applications, such as for scale inhibition or drilling aids. Methods of using the composition are also provided.

The polysaccharide graft polymers and graft copolymer compositions of the present invention are produced by selectively generating initiation sites (e.g., free radicals) for the growth of monomer side chains from an existing polymer backbone (Concise Encyclopedia of Polymer Science and Engineering, J. I. Kroschwitz, ed., Wiley-Interscience, New York, p. 436 (1990)). The polysaccharide graft polymer compositions are produced by reacting the polysaccharide with a free radical initiating system having a metal ion to generate free radicals on the polysaccharide, and polymerizing the free radical-containing polysaccharide with an ethylenically unsaturated monomer. In an embodiment, the graft polymer composition may be formed by polymerization catalyzed by a metal based radical initiator system, for example, based on Fe, Ce or Cu or salts thereof.

Graft polymers are defined as a backbone comprising a polysaccharide with one or more side chains derived from one or more ethylenically unsaturated monomers. Graft copolymer compositions such as would be suitable in the present invention, are described in U.S. Patent Application Publication No. 2008/0020961 and PCT Publication No. WO/2011/025624, each of which is incorporated by reference in its entirety herein.

As defined herein, the term "graft polymer composition" means a mixture of (a) graft polymers and (b) homopolymers of the ethylenically unsaturated monomer(s). The graft polymer composition thus contains the two moieties, (a) and (b). One skilled in the art will recognize that the graft polymer composition may also contain a certain amount of the unreacted polysaccharide. In an embodiment, the graft polymer composition is an anionic graft polymer composition. In another embodiment, the anionic polysaccharide graft polymer is a copolymer.

Polymerization may change a component from its original structure to a derivative structure. As used herein, the term "residue" refers to the starting component or anything derived from the component during polymerization which is part of the polymer. For example, a residue of acrylic acid includes acrylic acid and anything derived from acrylic acid during polymerization which is part of the polymer. In one example, the polysaccharide graft polymer composition can have a weight average molecular weight from about 2,000 g/mol to about 25,000 g/mol. In another embodiment, the polysaccharide graft polymer composition has a weight average molecular weight from about 5,000 g/mol to about 20,000 g/mol and in yet another embodiment from about 7,000 to about 15,000 g/mol. The weight average molecular weight may be determined by several methods, with Gel Permeation Chromotagraphy (GPC) using the appropriate methods and standards as the preferred method.

The residue of a polysaccharide includes a polysaccharide and anything derived from the polysaccharide during polymerization which is part of the polysaccharide graft polymer composition. Suitable polysaccharides can be derived from plant, animal and microbial sources. Example polysaccharides include but are not limited to maltodextrins, starches, cellulose, gums (e.g., gum arabic, guar and xanthan), alginates, pectin and gellan. Suitable starches include those derived from maize, potato, tapioca, wheat, rice, pea, sago, oat, barley, rye, and amaranth, including conventional grafts or genetically engineered materials. Additional example polysaccharides include hemicellulose or plant cell wall polysaccharides such as D-xylans.

The polysaccharides can be modified or derivatized by etherification (e.g., via treatment with propylene oxide, ethylene oxide, 2,3-epoxypropyltrimethylammonium chloride), esterification (e.g., via reaction with acetic anhydride, octenyl succinic anhydride ('OSA')), acid hydrolysis, dextrinization, oxidation or enzyme treatment (e.g., starch modified with α-amylase, β-amylase, pullanase, isoamylase or glucoamylase), or various combinations of these treatments.

The polysaccharide graft polymer composition also includes residue of at least one ethylenically unsaturated monomer. The preferred ethylenically unsaturated monomer is an anionic ethylenically unsaturated monomer. Examples of anionic ethylenically unsaturated monomers include but are not limited to acrylic acid, methacrylic acid, ethacrylic acid, α-chloro-acrylic acid, α-cyano acrylic acid, β-methylacrylic acid (crotonic acid), α-phenyl acrylic acid, β-acryloxy propionic acid, sorbic acid, α-chloro sorbic acid, angelic acid, cinnamic acid, p-chloro cinnamic acid, β-styryl acrylic acid (1-carboxy-4-phenyl butadiene-1,3), itaconic acid, maleic acid, citraconic acid, mesaconic acid, glutaconic acid, aconitic acid, fumaric acid, tricarboxy ethylene, 2-acryloxypropionic acid, 2-acrylamido-2-methyl propane sulfonic acid, vinyl sulfonic acid, sodium methallyl sulfonate, sulfonated styrene, allyloxybenzene sulfonic acid and maleic acid. The anionic ethylenically unsaturated monomers may include half esters of maleic and itaconic acid such as monomethyl, monoethyl, monopropyl, monobutyl, monoisopropyl and monotertbutyl maleate, and monomethyl, monoethyl, monopropyl, monobutyl, monoisopropyl and monotertbutyl itaconate. Moieties such as maleic anhydride or acrylamide that can be derivatized to an acid containing group can be used. Combinations of anionic ethylenically unsaturated monomers can also be used. In a preferred embodiment, the anionic ethylenically unsaturated monomers include acrylic acid, maleic acid, methacrylic acid, 2-acrylamido-2-methyl propane sulfonic acid, monomethyl maleate and/or mixtures thereof or their salts. In a more preferred embodiment, the acid-containing monomers are acrylic acid and/or methacrylic acid. As an example, the anionic polysaccharide hybrid copolymer composition includes acrylic acid residue. The residue of acrylic and methacrylic acid may be derived from acrylic and methacrylic acid monomers or may be generated from a hydrolyzable monomer. For example, a methacrylic acid residue may be partially or completely hydrolyzed from methyl methacrylate. The residues of acrylic acid and methacrylic acid may also be present as lithium, sodium, and potassium salts, ammonium and amine salts.

The polysaccharide graft polymer composition may optionally include residue of other ethylenically unsaturated monomers. In an embodiment, such other ethylenically unsaturated monomers are hydrophilic. Examples of other ethylenically unsaturated monomers include but are not limited to hydroxyalkyl (meth)acrylate or dialkyl maleate or dialkyl itaconate. A residue of hydroxyalkyl (meth)acrylate includes both hydroxyalkyl acrylate and hydroxyalkyl methacrylate. Examples of suitable hydroxyalkyl (meth)acrylates include but are not limited to hydroxymethyl, hydroxyethyl, hydroxypropyl, hydroxybutyl, hydroxyisopropyl and hydroxytertbutyl (meth)acrylates. Suitable dialkyl maleates include but are not limited to diethyl, dipropyl, dibutyl, diisopropyl and ditertbutyl maleate. Suitable dialkyl itaconates include but are not limited monomethyl, monoethyl, monopropyl, monobutyl, monoisopropyl and monotertbutyl itaconate. The polysaccharide graft polymer composition may optionally include residue of more than one ethylenically unsaturated monomer. In an example, the polysaccharide graft polymer composition includes residue of two ethylenically unsaturated monomers present in the polysaccharide graft copolymer composition in weight ratios from about 1:5 to about 5:1. In a preferred embodiment, acrylic acid and maleic acid are present in the polysaccharide graft polymer composition in weight ratios from about 1:5 to about 5:1.

A suitable concentration range of the components in the polysaccharide graft polymer include from about 5% to about 90% by weight polysaccharide residue and from about 10% to about 75% by weight residue of at least one ethylenically unsaturated monomer. In another embodiment, the polysaccharide graft polymer composition includes from about 30% to about 80% by weight polysaccharide residue and from about 10% to about 75% by weight residue of at least one ethylenically unsaturated monomer. A particularly suitable concentration range of the components in the polysaccharide graft polymer composition include from about 40% to about 70% by weight polysaccharide residue and from about 10% to about 50% by weight residue of the at least one ethylenically unsaturated monomer. The component weight percentages of the graft polymer composition given above and in the examples are based on the amounts of the respective ingredients as originally added to the graft polymer composition. One skilled in the art will recognize that the weight percent of each component in the final graft polymer composition may vary due to the polymerization process.

In another embodiment the cleaning composition is a detergent composition that generally includes an alkali metal hydroxide, water, and a polysaccharide graft polymer composition. The detergent composition, for example, may be particularly suitable for removing soil from a substrate, preventing soil redeposition and improving drainage. A suitable concentration range of the components in a concentrated form of the detergent compositions include from about 21% to about 80% by weight alkali metal hydroxide, from about 1% to about 40% by weight of water, and from about 0.1% to about 15% by weight of the polysaccharide graft polymer composition. A particularly suitable concentration range of the components in the detergent compositions include from about 21% to about 70% by weight alkali metal hydroxide, from about 5% to about 30% by weight of water, and from about 1% to about 10% by weight of the polysaccharide graft polymer composition.

Suitable alkali metal hydroxides include but are not limited to: sodium hydroxide, potassium hydroxide, lithium hydroxide, and combinations thereof. The alkali metal hydroxide may be added to the composition in any form known in the art, including as solid beads, dissolved in an aqueous solution, or a combination thereof. Additionally, more than one alkalinity source may be used according to certain embodiments.

The alkali metal hydroxide controls the pH of the resulting solution when water is added to the detergent composition to form a use solution. The pH of the use solution must be maintained in the alkaline range in order to provide sufficient detergency properties. In one embodiment, the pH of the use solution is from about 10.5 to about 12.5. Particularly, the pH of the use solution is about 11. If the pH of the use solution is too high, for example, above about 13, the use solution may be too alkaline and attack or damage the surface to be cleaned. If the pH of the use solution is too low, such as below about 9, sufficient detergency may not be provided.

The alkali metal hydroxide may also function as a hydratable salt to form a solid composition. The hydratable salt can be referred to as substantially anhydrous. By substantially anhydrous, it is meant that the component contains less than about 2% by weight water based upon the weight of the hydratable component. The amount of water can be less than about 1% by weight, and can be less than about 0.5% by weight. There is no requirement that the hydratable salt be completely anhydrous.

The detergent composition also includes water of hydration to hydrate the alkali metal hydroxide/hydratable salt. It should be understood that the reference to water includes both water of hydration and free water. The phrase "water of hydration" refers to water which is somehow attractively bound to a non-water molecule. An exemplary form of attraction includes hydrogen bonding. The water of hydration also functions to increase the viscosity of the mixture during processing and cooling to prevent separation of the components. The amount of water of hydration in the detergent composition will depend on the alkali metal hydroxide/hydratable salt. In addition to water of hydration, the detergent composition may also have free water which isn't attractively bound to a non-water molecule.

The detergent composition also includes a polysaccharide graft polymer composition. As discussed above, the polysaccharide graft polymer composition may be particularly helpful in improving drainage. A suitable concentration of the of the polysaccharide graft polymer composition in the detergent compositions is from about 0.5% to about 25% by weight of the detergent composition. A particularly suitable concentration of the polysaccharide graft polymer composition in the detergent compositions is from about 1% to about 15% by weight of the detergent composition.

The polysaccharide graft polymer composition can be a bio-based and/or biodegradable polymer, which reduces the reliance on natural gas and/or petrochemical feedstocks. Biobased content is the amount of biobased carbon in a material or product and can be expressed as a percent of weight (mass) of the total organic carbon in the product. The biobased content can be determined using ASTM Method D6866, entitled Standard Test Methods for Determining the Biobased Content of Natural Range Materials Using Radiocarbon and Isotrope Ratio Mass Spectrometry Analysis. Biodegradability measures the ability of microorganisms present in the disposal environment to completely consume the biobased carbon product within a reasonable time frame and in a specified environment. In one example, the polysaccharide graft polymer composition can include a polysaccharide and a reduced level of petrochemicals. For example, the detergent composition may include at least about 10 wt % biodegradable content. In another example, the detergent composition may include from about 10 wt. % to about 80 wt. % biodegradable content by weight.

The detergent compositions of the present invention can be provided in any of a variety of embodiments of detergent compositions. In an embodiment, the detergent composition is substantially free of phosphorous, nitrilotriacetic acid (NTA) and ethylenediaminetetraacetic acid (EDTA). Substantially phosphorus-free means a composition having less than about 0.5 wt. %, more particularly, less than about 0.1 wt. %, and even more particularly less than about 0.01 wt. % phosphorous based on the total weight of the composition. Substantially NTA-free means a composition having less than about 0.5 wt. %, less than about 0.1 wt. %, and particularly less than about 0.01 wt. % NTA based on the total weight of the composition. When the composition is NTA-free, it is also compatible with chlorine, which functions as an anti-redeposition and stain-removal agent. When diluted to a use solution, the detergent composition includes phosphorous-containing components, NTA and EDTA concentrations of less than about 100 ppm, particularly less than about 10 ppm, and more particularly less than about 1 ppm.

Additional Functional Materials

The composition can also include various additional functional components. In some embodiments, the polysaccharide graft polymer composition make up a large amount, or even substantially all of the total weight of the detergent composition, for example, in embodiments having few or no additional functional materials disposed therein. In one specific example, the composition consists essentially of the polysaccharide graft polymer composition. In these embodiments, the component concentration ranges provided above for the detergent are representative of the ranges of those same components in the detergent composition.

In other embodiments, the alkali metal hydroxide, water, and the polysaccharide graft polymer composition make up a large amount, or even substantially all of the total weight of the composition, for example, in embodiments having few or no additional functional materials disposed therein. In one specific example, the cleaning composition consists essentially of the alkali metal hydroxide, water, and the polysaccharide graft polymer composition. In these embodiments, the component concentration ranges provided above for the detergent are representative of the ranges of those same components in the composition.

In alternative embodiments, functional materials are added to provide desired properties and functionalities to the composition. For the purpose of this application, the term "functional materials" includes a material that when dispersed or dissolved in a use and/or concentrate solution, such as an aqueous solution, provides a beneficial property in a particular use. Some particular examples of functional materials are discussed in more detail below, although the particular materials discussed are given by way of example only, and that a broad variety of other functional materials may be used. Moreover, the components discussed above may be multifunctional and may also provide several of the functional benefits discussed below.

Secondary Alkali Source

The composition can include one or more secondary alkali sources. Examples of suitable secondary alkali sources of the composition include, but are not limited to alkali metal carbonates, alkali metal hydroxides and alkali metal silicates. Exemplary alkali metal carbonates that can be used include, but are not limited to: sodium or potassium carbonate, bicarbonate, sesquicarbonate, and mixtures thereof. Exemplary alkali metal hydroxides that can be used include, but are not limited to: sodium or potassium hydroxide. The alkali metal hydroxide may be added to the composition in any form known in the art, including as solid beads, dissolved in an aqueous solution, or a combination thereof. Examples of alkali metal silicates include, but are not limited to sodium or potassium silicate or polysilicate, sodium or potassium metasilicate and hydrated sodium or potassium metasilicate or a combination thereof.

Surfactants

The composition may also include a surfactant. A variety of surfactants can be used in the composition, including, but not limited to: anionic, nonionic, cationic, and zwitterionic surfactants. Exemplary surfactants that can be used are commercially available from a number of sources. For a discussion of surfactants, see Kirk-Othmer, Encyclopedia of Chemical Technology, Third Edition, volume 8, pages 900-912. When the composition includes a surfactant as a cleaning agent, the cleaning agent is provided in an amount effective to provide a desired level of cleaning. The composition, when provided as a concentrate, can include the surfactant cleaning agent in a range of about 0.05% to about 20% by weight, about 0.5% to about 15% by weight, about 1% to about 15% by weight, about 1.5% to about 10% by weight, and about 2% to about 8% by weight. Additional exemplary ranges of surfactant in a concentrate include about 0.5% to about 8% by weight, and about 1% to about 5% by weight.

Examples of anionic surfactants useful in the composition include, but are not limited to: carboxylates such as alkylcarboxylates and polyalkoxycarboxylates, alcohol ethoxylate carboxylates, nonylphenol ethoxylate carboxylates; sulfonates such as alkylsulfonates, alkylbenzenesulfonates, alkylarylsulfonates, sulfonated fatty acid esters; sulfates such as sulfated alcohols, sulfated alcohol ethoxylates, sulfated alkylphenols, alkylsulfates, sulfosuccinates, and alkylether sulfates. Exemplary anionic surfactants include, but are not limited to: sodium alkylarylsulfonate, alpha-olefinsulfonate, and fatty alcohol sulfates.

Examples of nonionic surfactants useful in the composition include, but are not limited to, those having a polyalkylene oxide polymer as a portion of the surfactant molecule. Such nonionic surfactants include, but are not limited to: chlorine-, benzyl-, methyl-, ethyl-, propyl-, butyl- and other like alkyl-capped polyethylene glycol ethers of fatty alcohols; polyalkylene oxide free nonionics such as alkyl polyglycosides; sorbitan and sucrose esters and their ethoxylates; alkoxylated amines such as alkoxylated ethylene diamine; alcohol alkoxylates such as alcohol ethoxylate propoxylates, alcohol propoxylates, alcohol propoxylate ethoxylate propoxylates, alcohol ethoxylate butoxylates; nonylphenol ethoxylate, polyoxyethylene glycol ether; carboxylic acid esters such as glycerol esters, polyoxyethylene esters, ethoxylated and glycol esters of fatty acids; carboxylic amides such as diethanolamine condensates, monoalkanolamine condensates, polyoxyethylene fatty acid amides; and polyalkylene oxide block polymers. An example of a commercially available ethylene oxide/propylene oxide block polymer includes, but is not limited to, PLURONIC®, available from BASF Corporation, Florham Park, N.J. and BEROL® available from AkzoNobel Surface Chemistry, Chicago, Ill. An example of a commercially available silicone surfactant includes, but is not limited to, ABIL® B8852, available from Goldschmidt Chemical Corporation, Hopewell, Va. A particularly suitable surfactant is D500, an ethylene oxide/propylene oxide polymer available from BASF Corporation, Florham Park, N.J.

Examples of cationic surfactants that can be used in the composition include, but are not limited to: amines such as primary, secondary and tertiary monoamines with $C_{18}$ alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like; and quaternary ammonium salts, as for example, alkylquaternary ammonium chloride surfactants such as n-alkyl($C_{12}$-$C_{18}$)dimethylbenzyl ammonium chloride, n-tetradecyldimethylbenzylammonium chloride monohydrate, and a naphthylene-substituted quaternary ammonium chloride such as dimethyl-1-naphthylmethylammonium chloride. The cationic surfactant can be used to provide sanitizing properties.

Examples of zwitterionic surfactants that can be used in the composition include, but are not limited to: betaines, imidazolines, and propionates.

When the composition is intended to be used in an automatic dishwashing or warewashing machine, the surfactants selected, if any surfactant is used, can be those that provide an acceptable level of foaming when used inside a dishwashing or warewashing machine. Compositions for use in automatic dishwashing or warewashing machines are generally considered to be low-foaming compositions. Low foaming surfactants that provide the desired level of detersive activity are advantageous in an environment such as a dishwashing machine where the presence of large amounts of foaming can be problematic. In addition to selecting low foaming surfactants, defoaming agents can also be utilized to reduce the generation of foam. Accordingly, surfactants that are considered low foaming surfactants can be used. In addition, other surfactants can be used in conjunction with a defoaming agent to control the level of foaming.

Builders or Water Conditioners

The cleaning composition can include one or more building agents, also called chelating or sequestering agents (e.g., builders), including, but not limited to: condensed phosphates, alkali metal carbonates, phosphonates, aminocarboxylic acids, and/or polyacrylates. In general, a chelating agent is a molecule capable of coordinating (i.e., binding) the metal ions commonly found in natural water to prevent the metal ions from interfering with the action of the other detersive ingredients of a cleaning composition. Preferable levels of addition for builders that can also be chelating or sequestering agents are from about 0.1% to about 70% by weight, about 1% to about 60% by weight, or about 1.5% to about 50% by weight, based on the total weight of the composition. If the solid composition is provided as a concentrate, the concentrate can include from about 1% to about 60% by weight, from about 3% to about 50% by weight, and from about 6% to about 45% by weight of the builders, based on the total weight of the concentrate. Additional ranges of the builders include from about 3% to about 20% by weight, from about 6% to about 15% by weight, from, about 25% to about 50% by weight, and from about 35% to about 45% by weight, based on the total weight of the composition.

Examples of condensed phosphates include, but are not limited to: sodium and potassium orthophosphate, sodium and potassium pyrophosphate, sodium tripolyphosphate, and sodium hexametaphosphate. A condensed phosphate may also assist, to a limited extent, in solidification of the composition by fixing the free water present in the composition as water of hydration.

Examples of phosphonates include, but are not limited to: 2-phosphonobutane-1,2,4-tricarboxylic acid (PBTC), 1-hydroxyethane-1,1-diphosphonic acid, $CH_2C(OH)[PO(OH)_2]_2$; aminotri(methylenephosphonic acid), $N[CH_2PO(OH)_2]_3$; aminotri(methylenephosphonate), sodium salt (ATMP), $N[CH_2PO(ONa)_2]_3$; 2-hydroxyethyliminobis(methylenephosphonic acid), $HOCH_2CH_2N[CH_2PO(OH)_2]_2$; diethylenetriaminepenta(methylenephosphonic acid), $(HO)_2POCH_2N[CH_2CH_2N[CH_2PO(OH)_2]_2]_2$; diethylenetriaminepenta(methylenephosphonate), sodium salt (DTPMP), $C_9H_{(28-x)}N_3Na_xO_{15}P_5$ (x=7); hexamethylenediamine(tetramethylenephosphonate), potassium salt, $C_{10}H_{(28-x)}N_2K_xO_{12}P_4$ (x=6); bis(hexamethylene)triamine(pentamethylenephosphonic acid), $(HO_2)POCH_2N[(CH_2)_2N[CH_2PO(OH)_2]_2]_2$; and phosphorus acid, $H_3PO_3$. A preferred phosphonate combination is ATMP and DTPMP. A neutralized or alkali phosphonate, or a combination of the phosphonate with an alkali source prior to being added into the mixture such that there is little or no heat or gas generated by a neutralization reaction when the phosphonate is added is preferred. In one embodiment, however, the cleaning composition is phosphorous-free.

Useful aminocarboxylic acid materials containing little or no NTA include, but are not limited to: N-hydroxyethylaminodiacetic acid, ethylenediaminetetraacetic acid (EDTA), hydroxyethylenediaminetetraacetic acid, diethylenetriaminepentaacetic acid, N-hydroxyethyl-ethylenediaminetriacetic acid (HEDTA), diethylenetriaminepentaacetic acid (DTPA), methylglycinediacetic acid (MGDA), glutamic acid-N,N-diacetic acid (GLDA), ethylenediaminesuccinic acid (EDDS), 2-hydroxyethyliminodiacetic acid (HEIDA), iminodisuccinic acid (IDS), 3-hydroxy-2-2'-iminodisuccinic acid (HIDS) and other similar acids or salts thereof having an amino group with a carboxylic acid substituent. In one embodiment, however, the composition is free of aminocarboxylates.

Water conditioning polymers can be used as non-phosphorus containing builders. Exemplary water conditioning polymers include, but are not limited to: polycarboxylates. Exemplary polycarboxylates that can be used as builders and/or water conditioning polymers include, but are not limited to: those having pendant carboxylate ($—CO_2^-$) groups such as polyacrylic acid, maleic acid, maleic/olefin polymer, sulfonated polymer or terpolymer, acrylic/maleic polymer, polymethacrylic acid, acrylic acid-methacrylic acid polymers, hydrolyzed polyacrylamide, hydrolyzed polymethacrylamide, hydrolyzed polyamide-methacrylamide polymers, hydrolyzed polyacrylonitrile, hydrolyzed polymethacrylonitrile, and hydrolyzed acrylonitrile-methacrylonitrile polymers. Other suitable water conditioning polymers include starch, sugar or polyols comprising carboxylic acid or ester functional groups. Exemplary carboxylic acids include but are not limited to maleic acid, acrylic, methacrylic and itaconic acid or salts thereof. Exemplary ester functional groups include aryl, cyclic, aromatic and $C_1$-$C_{10}$ linear, branched or substituted esters. For a further discussion of chelating agents/sequestrants, see Kirk-Othmer, Encyclopedia of Chemical Technology, Third Edition, volume 5, pages 339-366 and volume 23, pages 319-320, the disclosure of which is incorporated by reference herein. These materials may also be used at sub stoichiometric levels to function as crystal modifiers.

Hardening Agents

The cleaning compositions can also include a hardening agent in addition to, or in the form of, the builder. A hardening agent is a compound or system of compounds, organic or inorganic, which significantly contributes to the uniform solidification of the composition. Preferably, the hardening agents are compatible with the cleaning agent and other active ingredients of the composition and are capable of providing an effective amount of hardness and/or aqueous solubility to the processed composition. The hardening agents should also be capable of forming a homogeneous matrix with the cleaning agent and other ingredients when mixed and solidified to provide a uniform dissolution of the cleaning agent from the composition during use.

The amount of hardening agent included in the composition will vary according to factors including, but not limited to: the type of composition being prepared, the ingredients of the composition, the intended use of the composition, the quantity of dispensing solution applied to the solid composition over time during use, the temperature of the dispensing solution, the hardness of the dispensing solution, the physical size of the composition, the concentration of the other ingredients, and the concentration of the cleaning agent in the cleaning composition. It is preferred that the amount of the hardening agent included in the composition is effective to combine with the cleaning agent and other ingredients of the composition to form a homogeneous mixture under continuous mixing conditions and a temperature at or below the melting temperature of the hardening agent.

It is also preferred that the hardening agent form a matrix with the cleaning agent and other ingredients which will harden to a solid form under ambient temperatures of about 30° C. to about 50° C., particularly about 35° C. to about 45° C., after mixing ceases and the mixture is dispensed from the mixing system, within about 1 minute to about 3 hours, particularly about 2 minutes to about 2 hours, and particularly about 5 minutes to about 1 hour. A minimal amount of heat from an external source may be applied to the mixture to facilitate processing of the mixture. It is preferred that the amount of the hardening agent included in the composition is effective to provide a desired hardness and desired rate of controlled solubility of the processed composition when placed in an aqueous medium to achieve a desired rate of dispensing the cleaning agent from the solidified composition during use.

The hardening agent may be an organic or an inorganic hardening agent. A preferred organic hardening agent is a polyethylene glycol (PEG) compound. The solidification rate of compositions comprising a polyethylene glycol hardening agent will vary, at least in part, according to the amount and the molecular weight of the polyethylene glycol added to the composition. Examples of suitable polyethylene glycols include, but are not limited to: solid polyethylene glycols of the general formula $H(OCH_2CH_2)_nOH$, where n is greater than 15, particularly about 30 to about 1700. Typically, the polyethylene glycol is a solid in the form of a free-flowing powder or flakes, having a molecular weight of about 1,000 to about 100,000, particularly having a molecular weight of at least about 1,450 to about 20,000, more particularly from about 1,450 to about 8,000. The polyethylene glycol is present at a concentration of from about 1% to 75% by weight and particularly about 3% to about 15% by weight, based on the total weight of the composition. Suitable polyethylene glycol compounds include, but are not limited to: PEG 4000, PEG 1450, and PEG 8000 among others, with PEG 4000 and PEG 8000 being most preferred. An example of a commercially available solid polyethylene glycol includes, but is not limited to: CARBOWAX, available from Union Carbide Corporation, Houston, Tex.

Preferred inorganic hardening agents are hydratable inorganic salts, including, but not limited to: sulfates, carbonates and bicarbonates. The inorganic hardening agents are present at concentrations of up to about 50% by weight, from about 5% to about 50% by weight, particularly about 5% to about 25% by weight, and more particularly about 5% to about 15% by weight, based on total weight of the composition. In one embodiment, however, the solid composition if free of sulfates and carbonates including soda ash.

Urea particles can also be employed as hardeners in the compositions. The solidification rate of the compositions will vary, at least in part, to factors including, but not limited to: the amount, the particle size, and the shape of the urea added to the composition. For example, a particulate form of urea can be combined with a cleaning agent and other ingredients, and preferably a minor but effective amount of water. The amount and particle size of the urea is effective to combine with the cleaning agent and other ingredients to form a homogeneous mixture without the application of heat from an external source to melt the urea and other ingredients to a molten stage. It is preferred that the amount of urea included in the composition is effective to provide a desired hardness and desired rate of solubility of the composition when placed in an aqueous medium to achieve a desired rate of dispensing the cleaning agent from the solidified composition during use. In some embodiments, the composition includes from about 5% to about 90% by weight urea, particularly from about 8% to about 40% by weight urea, and more particularly from about 10% to about 30% by weight urea, based on total weight of the composition.

The urea may be in the form of prilled beads or powder. Prilled urea is generally available from commercial sources as a mixture of particle sizes ranging from about 8-15 U.S. mesh, as for example, from Arcadian Sohio Company, Nitrogen Chemicals Division. A prilled form of urea is preferably milled to reduce the particle size to about 50 U.S. mesh to about 125 U.S. mesh, particularly about 75-100 U.S. mesh, preferably using a wet mill such as a single or twin-screw extruder, a Teledyne mixer, a Ross emulsifier, and the like.

Bleaching Agents

Bleaching agents suitable for use in the composition for lightening or whitening a substrate include bleaching compounds capable of liberating an active halogen species, such as $Cl_2$, $Br_2$, —$OCl^-$ and/or —$OBr^-$, under conditions typically encountered during the cleansing process. Suitable bleaching agents for use in the compositions include, but are not limited to: chlorine-containing compounds such as chlorine, hypochlorites, or chloramines. Exemplary halogen-releasing compounds include, but are not limited to: the alkali metal dichloroisocyanurates, chlorinated trisodium phosphate, the alkali metal hypochlorites, monochloramine, and dichloramine. Encapsulated chlorine sources may also be used to enhance the stability of the chlorine source in the composition (see, for example, U.S. Pat. Nos. 4,618,914 and 4,830,773, the disclosure of which is incorporated by reference herein). A bleaching agent may also be a peroxygen or active oxygen source such as hydrogen peroxide, perborates, sodium carbonate peroxyhydrate, potassium permonosulfate, and sodium perborate mono and tetrahydrate, with and without activators such as tetraacetylethylene diamine. When the concentrate includes a bleaching agent, it can be included in an amount from about 0.1% to about 60% by weight, from about 1% to about 20% by weight, from about 3% to about 8% by weight, and from about 3% to about 6% by weight, based on the total weight of the composition.

Fillers

The composition can include an effective amount of detergent fillers which do not perform as a cleaning agent per se, but cooperates with the cleaning agent to enhance the overall cleaning capacity of the composition. Examples of detergent fillers suitable for use in the present cleaning compositions include, but are not limited to: sodium sulfate and sodium chloride. When the concentrate includes a detergent filler, it can be included in an amount up to about 50% by weight, from about 1% to about 30% by weight, or from about 1.5% from about 25% by weight, based on total weight of the composition.

Defoaming Agents

A defoaming agent for reducing the stability of foam may also be included in the composition. Examples of defoaming agents include, but are not limited to: ethylene oxide/propylene block polymers such as those available under the name Pluronic® N-3 available from BASF Corporation, Florham Park, N.J.; silicone compounds such as silica dispersed in polydimethylsiloxane, polydimethylsiloxane, and functionalized polydimethylsiloxane such as those available under the name Abil® B9952 available from Goldschmidt Chemical Corporation, Hopewell, Va.; fatty amides, hydrocarbon waxes, fatty acids, fatty esters, fatty alcohols, fatty acid soaps, ethoxylates, mineral oils, polyethylene glycol esters, and alkyl phosphate esters such as monostearyl phosphate. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated herein by reference. When the concentrate includes a defoaming agent, the defoaming agent can be provided in an amount from about 0.0001% to about 10% by weight, from about 0.001% to about 5% by weight, or from about 0.01% to about 1.0% by weight, based on total weight of the composition.

Anti-Redeposition Agents

The composition can include an anti-redeposition agent for facilitating sustained suspension of soils in a cleaning solution and preventing the removed soils from being redeposited onto the substrate being cleaned. Examples of suitable anti-redeposition agents include, but are not limited to: polyacrylates, styrene maleic anhydride polymers, cellulosic derivatives such as hydroxyethyl cellulose, hydroxypropyl cellulose and carboxymethyl cellulose. When the concentrate includes an anti-redeposition agent, the anti-redeposition agent can be included in an amount from about 0.5% to about 10% by weight, and from about 1% to about 5% by weight, based on total weight of the composition.

Stabilizing Agents

The composition may also include stabilizing agents. Examples of suitable stabilizing agents include, but are not limited to: borate, calcium/magnesium ions, propylene glycol, and mixtures thereof. The concentrate need not include a stabilizing agent, but when the concentrate includes a stabilizing agent, it can be included in an amount that provides the desired level of stability of the concentrate. Exemplary ranges of the stabilizing agent include up to about 20% by weight, from about 0.5% to about 20% by weight, from about 0.5% to about 15% by weight, and from about 2% to about 10% by weight, based on total weight of the composition.

Dispersants

The composition may also include dispersants. Examples of suitable dispersants that can be used in the composition include, but are not limited to: maleic acid/olefin polymers, polyacrylic acid, and mixtures thereof. The concentrate need not include a dispersant, but when a dispersant is included it can be included in an amount that provides the desired dispersant properties. Exemplary ranges of the dispersant in the concentrate can be up to about 20% by weight, from about 0.5% to about 20% by weight, from about 0.5% to about 15% by weight, and from about 2% to about 9% by weight based on the total weight of the composition.

Enzymes

Enzymes that can be included in the composition include those enzymes that aid in the removal of starch and/or protein stains. Exemplary types of enzymes include, but are not limited to: proteases, alpha-amylases, and mixtures thereof. Exemplary proteases that can be used include, but are not limited to: those derived from *Bacillus licheniformix, Bacillus lenus, Bacillus alcalophilus*, and *Bacillus amyloliquefacins*. Exemplary alpha-amylases include *Bacillus subtilis, Bacillus amyloliquefaceins* and *Bacillus licheniformis*. The concentrate need not include an enzyme, but when the concentrate includes an enzyme, it can be included in an amount that provides the desired enzymatic activity when the composition is provided as a use composition. Exemplary ranges of the enzyme in the concentrate include up to about 15% by weight, from about 0.5% to about 15% by weight, from about 0.5% to about 10% by weight, and from about 1% to about 5% by weight, based on total weight of the composition.

Fragrances and Dyes

Various dyes, odorants including perfumes, and other aesthetic enhancing agents can also be included in the composition. Suitable dyes that may be included to alter the appearance of the composition, include, but are not limited to: Direct Blue 86, available from Mac Dye-Chem Industries, Ahmedabad, India; Fastusol Blue, available from Mobay Chemical Corporation, Pittsburgh, Pa.; Acid Orange 7, available from American Cyanamid Company, Wayne, N.J.; Basic Violet 10 and Sandolan Blue/Acid Blue 182, available from Sandoz, Princeton, N.J.; Acid Yellow 23, available from Chemos GmbH, Regenstauf, Germany; Acid Yellow 17, available from Sigma Chemical, St. Louis, Mo.; Sap Green and Metanil Yellow, available from Keyston Analine and Chemical, Chicago, Ill.; Acid Blue 9, available from Emerald Hilton Davis, LLC, Cincinnati, Ohio; Hisol Fast Red and Fluorescein, available from Capitol Color and Chemical Company, Newark, N.J.; and Acid Green 25, Ciba Specialty Chemicals Corporation, Greenboro, N.C.

Fragrances or perfumes that may be included in the compositions include, but are not limited to: terpenoids such as citronellol, aldehydes such as amyl cinnamaldehyde, a jasmine such as C1S-jasmine or jasmal, and vanillin.

In an embodiment, these aesthetic enhancing agents can be included in the composition in an amount from about 0.1% to about 5%, based on total weight of the composition.

Thickeners

The compositions can include a rheology modifier or a thickener. The rheology modifier may provide the following functions: increasing the viscosity of the compositions; increasing the particle size of liquid use compositions when dispensed through a spray nozzle; providing the use compositions with vertical cling to surfaces; providing particle suspension within the use compositions; or reducing the evaporation rate of the use compositions.

The rheology modifier may provide a use composition that is pseudo plastic, in other words the use composition or material when left undisturbed (in a shear mode), retains a high viscosity. However, when sheared, the viscosity of the material is substantially but reversibly reduced. After the shear action is removed, the viscosity returns. These properties permit the application of the material through a spray head. When sprayed through a nozzle, the material undergoes shear as it is drawn up a feed tube into a spray head under the influence of pressure and is sheared by the action of a pump in a pump action sprayer. In either case, the viscosity can drop to a point such that substantial quantities of the material can be applied using the spray devices used to apply the material to a soiled surface. However, once the material comes to rest on a soiled surface, the materials can regain high viscosity to ensure that the material remains in place on the soil. Preferably, the material can be applied to a surface resulting in a substantial coating of the material that provides the cleaning components in sufficient concentration to result in lifting and removal of the hardened or baked-on soil. While in contact with the soil on vertical or inclined surfaces, the thickeners in conjunction with the other components of the cleaner minimize dripping, sagging, slumping or other movement of the material under the effects of gravity. The material should be formulated such that the viscosity of the material is adequate to maintain contact between substantial quantities of the film of the material with the soil for at least a minute, particularly five minutes or more.

Examples of suitable thickeners or rheology modifiers are polymeric thickeners including, but not limited to: polymers or natural polymers or gums derived from plant or animal sources. Such materials may be polysaccharides such as large polysaccharide molecules having substantial thickening capacity. Thickeners or rheology modifiers also include clays.

A substantially soluble polymeric thickener can be used to provide increased viscosity or increased conductivity to the use compositions. Examples of polymeric thickeners for the aqueous compositions of the invention include, but are not limited to: carboxylated vinyl polymers such as polyacrylic acids and sodium salts thereof, ethoxylated cellulose, polyacrylamide thickeners, cross-linked, xanthan compositions, sodium alginate and algin products, hydroxypropyl cellulose, hydroxyethyl cellulose, and other similar aqueous thickeners that have some substantial proportion of water solubility. Examples of suitable commercially available thickeners include, but are not limited to: Acusol, available from Rohm & Haas Company, Philadelphia, Pa.; ALCOGUM® available from AkzoNobel, Chicago, Ill. and Carbopol, available from B.F. Goodrich, Charlotte, N.C.

Examples of suitable polymeric thickeners include, but not limited to: polysaccharides. An example of a suitable commercially available polysaccharide includes, but is not limited to, Diutan, available from Kelco Division of Merck, San Diego, Calif. Thickeners for use in the compositions further include polyvinyl alcohol thickeners, such as, fully hydrolyzed (greater than 98.5 mol acetate replaced with the —OH function).

An example of a particularly suitable polysaccharide includes, but is not limited to, xanthans. Such xanthan polymers are preferred due to their high water solubility, and great thickening power. Xanthan is an extracellular polysaccharide of *xanthomonas* campestras. Xanthan may be made by fermentation based on corn sugar or other corn sweetener byproducts. Xanthan comprises a poly beta-(1-4)-D-Glucopyranosyl backbone chain, similar to that found in cellulose. Aqueous dispersions of xanthan gum and its derivatives exhibit novel and remarkable rheological properties. Low concentrations of the gum have relatively high viscosities which permit it to be used economically. Xanthan gum solutions exhibit high pseudo plasticity, i.e. over a wide range of concentrations, rapid shear thinning occurs that is generally understood to be instantaneously reversible. Non-sheared materials have viscosities that appear to be independent of the pH and independent of temperature over wide ranges. Preferred xanthan materials include crosslinked xanthan materials. Xanthan polymers can be crosslinked with a variety of known covalent reacting crosslinking agents reactive with the hydroxyl functionality of large polysaccharide molecules and can also be crosslinked using divalent, trivalent or polyvalent metal ions. Such crosslinked xanthan gels are disclosed in U.S. Pat. No. 4,782,901, which is herein incorporated by reference. Suitable crosslinking agents for xanthan materials include, but are not limited to: metal cations such as Al+3, Fe+3, Sb+3, Zr+4 and other transition metals. Examples of suitable commercially available xanthans include, but are not limited to: KELTROL®, KELZAN® AR, KELZAN® D35, KELZAN® S, KELZAN® XZ, available from Kelco Division of Merck, San Diego, Calif. Known organic crosslinking agents can also be used. A preferred crosslinked xanthan is KELZAN® AR, which provides a pseudo plastic use composition that can produce large particle size mist or aerosol when sprayed.

In an embodiment, the rheology modifiers and thickeners may be included in the composition in an amount from about 0.1 to about 5.0 weight %, based on total weight of the composition.

Methods of Manufacture

In general, the composition of the present invention can be created by combining the polysaccharide graft polymer compositions and any additional functional components and allowing the components to interact.

In one example, the alkali metal hydroxide, water, the polysaccharide graft polymer and any additional functional components interact and harden into solid form. The solidification process may last from a few minutes to about six hours, depending on factors including, but not limited to: the size of the formed or cast composition, the ingredients of the composition, and the temperature of the composition.

The solid compositions may be formed using a batch or continuous mixing system. In an exemplary embodiment, a single- or twin-screw extruder is used to combine and mix one or more cleaning agents at high shear to form a homogeneous mixture. In some embodiments, the processing temperature is at or below the melting temperature of the components. The processed mixture may be dispensed from the mixer by forming, casting or other suitable means, whereupon the composition hardens to a solid form. The structure of the matrix may be characterized according to its hardness, melting point, material distribution, crystal structure, and other like properties according to known methods in the art. Generally, a solid composition processed according to the method of the invention is substantially homogeneous with regard to the distribution of ingredients throughout its mass and is dimensionally stable.

In an extrusion process, the liquid and solid components are introduced into final mixing system and are continuously mixed until the components form a substantially homogeneous semi-solid mixture in which the components are distributed throughout its mass. The mixture is then discharged from the mixing system into, or through, a die or other shaping means. The product is then packaged. In an exemplary embodiment, the formed composition begins to harden to a solid form in from about 1 minute to about 3 hours. Particularly, the formed composition begins to harden to a solid form from about 1 minute to about 2 hours. More particularly, the formed composition begins to harden to a solid form from about 1 minute to about 20 minutes.

In a casting process, the liquid and solid components are introduced into the final mixing system and are continuously mixed until the components form a substantially homogeneous liquid mixture in which the components are distributed throughout its mass. In an exemplary embodiment, the components are mixed in the mixing system for at least about 60 seconds. Once the mixing is complete, the product is transferred to a packaging container where solidification takes place. In an exemplary embodiment, the cast composition begins to harden to a solid form in from about 1 minute to about 3 hours. Particularly, the cast composition begins to harden to a solid form in from about 1 minute to about 2 hours. More particularly, the cast composition begins to harden to a solid form about 1 minute to about 20 minutes.

By the term "solid", it is meant that the hardened composition will not flow and will substantially retain its shape under moderate stress or pressure or mere gravity. The degree of hardness of the solid cast composition may range from that of a fused solid product which is relatively dense and hard, for example, like concrete, to a consistency characterized as being a hardened paste. In addition, the term "solid" refers to the state of the composition under the expected conditions of storage and use of the solid composition. In general, it is expected that the composition will remain in solid form when exposed to temperatures of up to about 100° F. and particularly up to about 120° F.

The resulting solid composition may take forms including, but not limited to: a cast solid product; an extruded, molded or formed solid pellet, block, tablet, powder, granule, flake; or the formed solid can thereafter be ground or formed into a powder, granule, or flake. In an exemplary embodiment, extruded pellet materials formed by the solidification matrix have a weight of about 50 grams to about 250 grams, extruded solids formed by the composition have a weight of about 100 grams or greater, and solid block detergents formed by the composition have a mass of about 1 to about 10 kilograms. The solid compositions provide for a stabilized source of functional materials. In some embodiments, the solid composition may be dissolved, for example, in an aqueous or other medium, to create a concentrated and/or use composition. The solution may be directed to a storage reservoir for later use and/or dilution, or may be applied directly to a point of use.

In certain embodiments, the solid composition is provided in the form of a unit dose. A unit dose refers to a solid composition unit sized so that the entire unit is used during a single washing cycle. When the solid composition is provided as a unit dose, it is typically provided as a cast solid, an extruded pellet, or a tablet having a size of about 1 gram to about 50 grams.

In other embodiments, the solid composition is provided in the form of a multiple-use solid, such as a block or a plurality of pellets, and can be repeatedly used to generate aqueous compositions for multiple washing cycles. In certain embodiments, the solid composition is provided as a cast solid, an extruded block, or a tablet having a mass of about 5 grams to about 10 kilograms. In certain embodiments, a multiple-use form of the solid composition has a mass of about 1 kilogram to about 10 kilograms. In further embodiments, a multiple-use form of the solid composition has a mass of about 5 kilograms to about 8 kilograms. In other embodiments, a multiple-use form of the solid composition has a mass of about 5 grams to about 1 kilogram, or of about 5 grams to about 500 grams.

Although the composition is discussed as being formed into a solid product, the composition may also be provided in the form of a paste or liquid. When the concentrate is provided in the form of a paste, enough water is added to the composition such that complete solidification of the composition is precluded. In addition, dispersants and other components may be incorporated into the composition in order to maintain a desired distribution of components.

Methods of Use

The compositions can include concentrate compositions which may be added to an aqueous system or may be diluted to form use compositions. In general, a concentrate refers to a composition that is intended to be added to or diluted with water, and the composition that contacts articles to be washed can be referred to as the use composition.

A use composition may be prepared from the concentrate by diluting the concentrate with water at a dilution ratio that provides a use composition having desired detersive properties. The water that is used to dilute the concentrate to form the use composition can be referred to as water of dilution or a dilutent, and can vary from one location to another. The use composition can also include additional functional ingredients at a level suitable for cleaning, rinsing, or the like.

The concentrate compositions may essentially include only the polysaccharide polymer composition, and additional components and/or functional materials may be added as separate ingredients prior to the point of use or at the point of use. Alternatively, the concentrate compositions may include the polysaccharide graft polymer composition as well as additional components such as, but not limited to, at least one alkali metal hydroxide.

The typical dilution factor is from about 1 to about 10,000 but will depend on factors including water hardness, the amount of soil to be removed and the like. In one embodiment, the concentrate is diluted at a ratio of about 1:10 to about 1:1000 concentrate to water. Particularly, the concentrate is diluted at a ratio of about 1:100 to about 1:5000 concentrate to water. More particularly, the concentrate is diluted at a ratio of about 1:250 to about 1:2000 concentrate to water.

A suitable concentration range of the components includes of about 1 to about 500 parts-per-million (ppm) of the polysaccharide graft polymer composition. A particularly suitable concentration range of the components includes from about 5 to about 500 parts-per-million (ppm) of the polysaccharide graft polymer composition. Another particularly suitable concentration range of the components includes from about 10 to about 100 ppm of the polysaccharide graft polymer composition.

When an alkali metal hydroxide is present, a suitable concentration range of the components in the use composition includes about 150 to about 1500 ppm alkali metal hydroxide, and from about 1 to about 500 ppm of the polysaccharide graft polymer composition. A particularly suitable concentration range of the components in the use composition includes from about 150 and about 1000 ppm alkali metal hydroxide, and from about 5 to 500 ppm of the polysaccharide graft polymer composition. Another particularly suitable concentration range of the components in the use composition includes from about 200 to about 800 ppm alkali metal hydroxide, and from about 10 to about 100 ppm of the polysaccharide graft polymer composition.

The cleaning composition can contain an effective concentration of the alkali metal hydroxide so that use composition has a pH from about 10.5 to about 12.5. In one embodiment, the composition is a use composition that can be brought into contact to clean articles or substrates, such as glass, plastic, ceramic, and metal, and the polysaccharide graft polymer composition may function to prevent or remove re-deposition of protein on the substrate.

EXAMPLES

The present invention is more particularly described in the following examples that are intended as illustrations only, since numerous modifications and variations within the scope of the present invention will be apparent to those of skill in the art. Unless otherwise noted, all parts, percentages, and ratios reported in the following examples are on a weight bases, and all reagents used in the examples were obtained, or are available, from the chemical suppliers described below, or may be synthesized by conventional techniques.

Materials Used

Acusol 445ND: an acrylic acid homopolymer.

Acusol 448 (45%): a 3000 MW polyacrylic:polymaleic copolymer.

Pluronic® N-3: a ethylene oxide/propylene oxide block polymer surfactant available from BASF Corporation.

EXP 1: a polysaccharide graft polymer composition containing about 65% by weight polysaccharide reside and about 35% by weight residue of acrylic acid and maleic acid monomers in a weight ratio of 3:2.

Synthesis of EXP 1

A reactor containing 125 grams of water was taken and 100 grams of DE 10 maltodextrin was dissolved to form an aqueous solution. 20.5 grams of maleic anhydride was added to this reactor and neutralized by drop wise addition of 20.9 grams of 50% sodium hydroxide and 0.00075 grams of Ferrous ammonium sulfate hexahydrate was then added the reaction mixture was heated to 95° C. A monomer feed containing 122.9 grams of acrylic acid was added to the reactor over a period of 3 hours. An initiator solution comprising 23.5 grams of 35% hydrogen peroxide solution and 2.3 grams of persulfate dissolved in 10 grams of water was simultaneously added to the reactor over a period of 3 hours and 15 minutes. The reaction product was held at 95° C. for 30 minutes. The polymer was then neutralized by adding 24 grams of a 50% solution of sodium hydroxide and then 0.7 grams of Proxel GXL was added as a biocide. The resulting polysaccharide graft polymer composition contained about 65% by weight polysaccharide reside and about 35% by weight residue of acrylic acid and maleic acid monomers in a weight ratio of 3:2.

Cleaning Libby Glasses

Libby glasses and 316 stainless steel cups were prepared for laboratory warewashing procedures by removing all film and foreign material from the glass surface. A three-gallon stainless steel pail was filled with distilled water and placed on a hot plate set on high. The pail was covered with aluminum foil and brought to boil.

While the water in the pail was brought to a boil, the ware was placed on a glass rack and loaded in a Hobart AM-15 warewash machine. The warewash machine had a washbath volume of 60 L, a rinse volume of 4.5 L, a wash time of 50 seconds and a rinse time of 9 seconds. The warewash machine was filled with hot soft water (130° F. minimum) and 20 grams of Lime-A-Way, the door was closed and the automatic cycle was run.

When the cycle was complete, the warewash machine was drained, refilled with hot soft water and 20 grams of Guardian Plus, and the automatic cycle was run. When the cycle was complete, the warewash machine was drained, refilled with hot soft water and 10 grams of sodium tripolyphosphate, and the automatic cycle was run again.

After completion of the automatic cycle with polyphosphate, the machine was drained and refilled with the boiling distilled water from the pail. The control panel was switched to a delime setting and the machine was allowed to run with the distilled water for three minutes. After three minutes, the wares were removed and the tops were mopped with a clean, dry towel. The wares were allowed to dry in the glass rack. The rack may be elevated on one side to facilitate draining and drying.

Warewashing Test

Food soils were prepared by combining a 50:50 mixture of beef stew and hot point soil at 2000 ppm. The soil included 2 cans of Dinty Moore Beef Stew (1360 g), 1 large can of tomato sauce (822 g), 15.5 sticks of Blue Bonnet Margarine (1746 g) and powdered milk (436.4 g).

To determine the ability of various detergent compositions to enhance drainage from ware, glass tumblers and 316 stainless steel cups were prepared by removing all film and foreign material from the surfaces of the ware as described above. New plastic tumblers were used for each experiment.

A Hobart AM-15 warewash machine was then filled with an appropriate amount of water and the water was tested for hardness. After recording the hardness value, the tank heaters were turned on. On the day of the experiments, the water hardness was 17 grains (1 grain=17 parts-per-million). The warewash machine was turned on and wash/rinse cycles were run through the machine until a wash temperature of between about 150° F. and about 160° F. and a rinse temperature of between about 175° F. and about 190° F. were reached. The controller was then set to dispense an appropriate amount of detergent into the wash tank. The detergent was dispensed such that when the detergent was mixed with water during the cycle to form a use solution, the detergent concentration in the use solution is specified in Table 1. The solution in the wash tank was titrated to verify detergent concentration. The warewash machine had a washbath volume of 53 liters, a rinse volume of 2.8 liters, a washtime of 50 seconds, and a rinse time of 9 seconds.

For each experiment, two clean glass tumblers, two new plastic tumblers and two stainless steel tumblers were individually weighted and then placed diagonally in a Raburn rack (see table below for arrangement) and the rack was placed inside the warewash machine. (P=plastic tumbler; G=glass tumbler; M=316 stainless steel tumbler).

| | | | | | |
|---|---|---|---|---|---|
| | | | | | M6 |
| | | | | P5 | |
| | | | G4 | | |
| | | M3 | | | |
| | P2 | | | | |
| G1 | | | | | |

For each test, the appropriate amounts of detergent and 2000 ppm of the food soil were dosed into the warewash machine. The rack was placed in the warewash machine and the door was closed to start a cycle. Immediately after the rinse cycle was completed, a 30 second timer was started. At the completion of the 30 second period, the dish rack was removed from the warewash machine and was tilted about 45 degrees to facilitate drainage from the tops of the plastic cups. The rack was then placed on a flat bench top. After an additional 30 seconds elapsed, the cups were individually weighed in the order G1, P2, M3, G4, P5 and M6. The initial weight of each tumbler was subtracted from the final weights to determine the amount of water remaining on each tumbler, where a reduced amount of water indicates improved drainage.

Example 1 and Comparative Examples A-B

Example 1 included a polysaccharide graft polymer composition. Comparative Examples A and B do not include any polysaccharide graft polymer compositions. The component concentrations (in weight percent) of the detergent compositions of Example 1 and Comparative Examples A-B are presented below in Table 1:

TABLE 1

| | Comparative Example A | Comparative Example B | Example 1 |
|---|---|---|---|
| water | 22.4 | 7.81 | 7.82 |
| NaOH | 64.5 | 64.9 | 64.5 |
| Acusol 445 ND | 11.45 | 0 | 0 |
| Acusol 448 | 0 | 25.63 | 0 |
| Pluronic N3 | 1.65 | 1.66 | 1.65 |
| EXP 1, 44% | 0 | 0 | 26.03 |
| Total | 100 | 100 | 100 |
| Use Concentration (ppm) | 698 | 693 | 698 |

Table 2 presents the average amount of water (in grams) remaining on the ware. Each experiment was run in duplicate and each trial included two of each substrate. The sums of water remaining were used to calculate averages and standard deviations.

TABLE 2

| | Glass | Std. dev. | Plastic | Std. dev. | Metal | Std. dev. | Combined | Std. dev. |
|---|---|---|---|---|---|---|---|---|
| Comp. A | 1.14 | 0.09 | 2.26 | 0.26 | 0.87 | 0.05 | 4.26 | 0.12 |
| Comp. B | 1.55 | 0.13 | 2.07 | 0.21 | 1.09 | 0.09 | 4.69 | 0.25 |
| Example 1 | 0.79 | 0.08 | 1.28 | 0.15 | 0.77 | 0.21 | 2.83 | 0.04 |

The polysaccharide graft polymer composition improved drainage in comparison to the Comparative Examples that did not include any polysaccharide graft polymer composition. In viewing the combined results, it can be seen that EXP 1 provided improved drainage on both glass and polymer substrates.

Examples 2-3

Examples 2 and 3 demonstrate the effect of reducing the amount of caustic included in the compositions. Example 3 is similar to Example 2 but includes only 10 weight percent sodium hydroxide. Glass tumblers were prepared as discussed above and new plastic tumblers were used for each experiment.

For each experiment, six clean glass tumblers were placed diagonally in a Raburn rack (see table below for arrangement) along with an offset plastic tumbler and the rack was placed inside the warewash machine. (P=plastic tumbler; G=glass tumbler).

G6
G5
G4
G3
G2 P
G1

For each test, the appropriate amounts of detergent was dosed into the warewash machine. The rack was placed in the warewash machine and one wash cycle (no rinse) was performed. The rack was removed from the warewash machine and the ware was allowed to dry for 24 hours. The ware was then visually analyzed for spotting, using the scale shown in Table 3:

TABLE 3

| Rating | Spots |
|---|---|
| 1 | No spots |
| 2 | Spots covering 20% of surface |
| 3 | Spots covering 40% of surface |
| 4 | Spots covering 60% of surface |
| 5 | Spots covering at least 80% of surface |

Table 4 below provides the compositions for Examples 2 and 3:

TABLE 4

| | Example 2 | Example 3 |
|---|---|---|
| water | 7.82 | 62.32 |
| NaOH | 64.5 | 10 |
| Pluronic N3 | 1.65 | 1.65 |
| EXP 1, 40% | 26.03 | 26.03 |
| Total | 100 | 100 |
| Use Conc. (ppm) | 698 | 698 |

The ware was evaluated using the scale shown above in Table 3. Table 5 below provides the visual results, where G indicates glass and P indicates plastic.

TABLE 5

| | G1 | G2 | G3 | G4 | G5 | G6 | P | Total |
|---|---|---|---|---|---|---|---|---|
| Exp. 2 | 1 | 1 | 1 | 1 | 1 | 1 | 2 | 8 |
| Exp. 2 | 1 | 2 | 2 | 1 | 1 | 1 | 2 | 10 |
| Exp. 3 | 3 | 3 | 3 | 3 | 2 | 3 | 3 | 20 |
| Exp. 3 | 3 | 3 | 3 | 3 | 3 | 3 | 3 | 21 |

As can be seen, Example 3, which included a relatively low level of caustic, demonstrated higher spotting in comparison with the higher levels of caustic included in Example 2. The higher spotting suggests reduced detergency of Example 3.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

What is claimed:

1. A cleaning composition comprising:

at least one alkali metal hydroxide present in an amount from about 21% to about 80% by weight of the cleaning composition;

water;

a surfactant comprising an ethylene oxide/propylene oxide block polymer; and a polysaccharide graft polymer composition comprising:

polysaccharide residue in an amount from about 5% to about 90% by weight of the polysaccharide graft polymer composition; and residue of at least one ethylenically unsaturated monomer present in an amount from about 10% to about 75% by weight of the polysaccharide graft polymer composition.

2. The cleaning composition of claim 1, wherein the at least one ethylenically unsaturated monomer includes at least one ethylenically unsaturated anionic monomer.

3. The cleaning composition of claim 1, wherein the at least one ethylenically unsaturated monomer includes at least one member selected from the group consisting of acrylic acid, methacrylic acid, ethacrylic acid, α-chloro-acrylic acid, α-cyano acrylic acid, β-methyl-acrylic acid (crotonic acid), α-phenyl acrylic acid, β-acryloxy propionic acid, sorbic acid, α-chloro sorbic acid, angelic acid, cinnamic acid, p-chloro cinnamic acid, β-styryl acrylic acid (1-carboxy-4-phenyl butadiene-1,3), itaconic acid, maleic acid, citraconic acid, mesaconic acid, glutaconic acid, aconitic acid, fumaric acid, tricarboxy ethylene, 2-acryloxypropionic acid, 2-acrylamido-2-methyl propane sulfonic acid, vinyl sulfonic acid, sodium methallyl sulfonate, sulfonated styrene, allyloxybenzene sulfonic acid, monomethyl maleate, their salts and combinations thereof; and wherein the surfactant further comprises one or more of the following: a carboxylate, a sulfonate, a sulfate, a chlorine-capped polyethylene glycol ether of a fatty alcohol, a benzyl-capped polyethylene glycol ether of a fatty alcohol, an alkyl-capped polyethylene glycol ether of a fatty alcohol, an alkyl polyglycoside, a sorbitan ester, a sucrose ester, an alkoxylated amine, an alcohol alkoxylate, a carboxylic acid ester, a carboxylic amide, an amine, a quaternary ammonium salt, a betaine, an imidazoline, and a propionate.

4. The cleaning composition of claim 3, wherein the at least one ethylenically unsaturated monomer is acrylic acid, maleic acid, methacrylic acid, maleic acid, 2-acrylamido-2-methyl propane sulfonic acid, monomethyl maleate, their salts or a combination thereof.

5. The cleaning composition of claim 1, wherein the at least one alkali metal hydroxide includes sodium hydroxide, potassium hydroxide, lithium hydroxide or combinations thereof.

6. The cleaning composition of claim 1, wherein the polysaccharide graft polymer composition has a weight average molecular weight from about 2,000 g/mol to 25,000 g/mol.

7. The cleaning composition of claim 1, Wherein the polysaccharide graft polymer composition is present in an amount from about 0.1% to about 15% by weight of the cleaning composition.

8. The cleaning composition of claim 1, wherein the cleaning composition contains at least about 10% biodegradable content by weight.

9. The cleaning composition of claim 1, wherein the cleaning composition consists essentially of:

at east one alkali metal hydroxide;

water;

the polysaccharide graft polymer composition;

the ethylene oxide/propylene oxide block polymer; and at least one active ingredient.

10. A method of cleaning a substrate with a detergent composition, the method comprising:

mixing water with the detergent composition to form a use solution; and contacting the substrate with the use solution, wherein the use solution comprises:

at least one alkali metal hydroxide present in an amount from about 150 ppm to about 1500 ppm;

a surfactant comprising an ethylene oxide/propylene oxide block polymer; and a polysaccharide graft polymer composition present in an amount from about 5 ppm to about 500 ppm, the polysaccharide graft polymer composition comprising from about 5% to about 90% by weight polysaccharide residue and from about 10% to about 75% by weight residue of at least one ethylenically unsaturated monomer, and wherein the use solution has a pH in the range from about 10.5 to about 12.5.

11. The method of claim 10, wherein the at least one ethylenically unsaturated monomer includes at least one ethylenically unsaturated anionic monomer.

12. The method of claim 10, wherein the at least one ethylenically unsaturated monomer includes at least one member selected from the group consisting of acrylic acid, methacrylic acid, ethacrylic acid, α-chloro-acrylic acid, α-cyano acrylic acid, β-methyl-acrylic acid (crotonic acid), α-phenyl acrylic acid, β-acryloxy propionic acid, sorbic acid, α-chloro sorbic acid, angelic acid, cinnamic acid, p-chloro cinnamic acid, β-styryl acrylic acid (1-carboxy-4-phenyl butadiene-1,3), itaconic acid, maleic acid, citraconic acid, mesaconic acid, glutaconic acid, aconitic acid, fumaric acid, tricarboxy ethylene, 2-acryloxypropionic acid, 2-acrylamido-2-methyl propane sulfonic acid, vinyl sulfonic acid, sodium methallyl sulfonate, sulfonated styrene, allyloxybenzene sulfonic acid, monomethyl maleate, their salts and combinations thereof.

13. The method of claim 12, wherein the at least one ethylenically unsaturated monomer is acrylic acid, methacrylic acid, maleic acid, 2-acrylamido-2-methyl propane sulfonic acid, monomethyl maleate, their salts or a combination thereof.

14. The method of claim 10, wherein the at least one alkali metal hydroxide includes sodium hydroxide, potassium hydroxide, lithium hydroxide or combinations thereof.

15. The method of claim 10, where the polysaccharide graft polymer composition has a weight average molecular weight from about 2,000 g/mol to about 25,000 g/mol.

16. A method for improving rinse water drainage from ware being washed, the method comprising:

contacting the ware with a use solution that includes:

sufficient alkali metal hydroxide to provide the use solution with a pH that is in the range of about 10.5 to about 12.5;

a surfactant comprising an ethylene oxide/propylene oxide polymer; and about 5 to about 500 ppm of a polysaccharide graft polymer composition comprising:

polysaccharide residue in an amount from about 5% to about 90% by weight of the polysaccharide graft polymer composition; and residue of at least one ethylenically unsaturated monomer present in an amount from about 10% to about 75% by weight of the polysaccharide graft polymer composition.

17. The method of claim 16, wherein the at least one alkali metal hydroxide includes sodium hydroxide, potassium hydroxide, lithium hydroxide or combinations thereof.

18. The method of claim 16 wherein the at least one ethylenically unsaturated monomer includes at least one ethylenically unsaturated anionic monomer.

19. The method of claim 16, wherein the at least one ethylenically unsaturated monomer includes at least one member selected from the group consisting of acrylic acid, methacrylic acid, ethacrylic acid, α-chloro-acrylic acid, α-cyano acrylic acid, β-methyl-acrylic acid (crotonic acid), α-phenyl acrylic acid, β-acryloxy propionic acid, sorbic acid, α-chloro sorbic acid, angelic acid, cinnamic acid, p-chloro cinnamic acid, β-styryl acrylic acid (1-carboxy-4-phenyl butadiene-1,3), itaconic acid, maleic acid, citraconic acid, mesaconic acid, glutaconic acid, aconitic acid, fumaric acid, tricarboxy ethylene, 2-acryloxypropionic acid, 2-acrylamido-2-methyl propane sulfonic acid, vinyl sulfonic acid, sodium methallyl sulfonate, sulfonated styrene, allyloxybenzene sulfonic acid, monomethyl maleate, their salts and combinations thereof.

20. The method of claim 19, wherein at least one ethylenically unsaturated monomer is acrylic acid, methacrylic acid, maleic acid, 2-acrylamido-2-methyl propane sulfonic acid, monomethyl maleate, their salts or a combination thereof.

* * * * *